United States Patent [19]

Osborne

[11] Patent Number: 4,667,816

[45] Date of Patent: May 26, 1987

[54] AMMUNITION CANISTER RESTRAINING LATCHES

[75] Inventor: Mark W. Osborne, Fridley, Minn.

[73] Assignee: FMC Corporation, Chicago, Ill.

[21] Appl. No.: 742,242

[22] Filed: Jun. 7, 1985

[51] Int. Cl.[4] ..... F42B 37/00

[52] U.S. Cl. ..... 206/3; 89/34; 206/446

[58] Field of Search ..... 89/1.7, 34; 206/3, 317, 206/319, 587, 588, 591, 592, 443, 446, 521; 211/60.1, 89

[56] References Cited

U.S. PATENT DOCUMENTS

| | | | |
|---|---|---|---|
| 1,935,669 | 11/1933 | Rogers | 206/3 |
| 3,072,022 | 1/1963 | Wood et al. | 206/3 |
| 3,160,062 | 12/1964 | Moy et al. | 206/3 |
| 3,465,871 | 9/1969 | Lyons et al. | 206/3 |
| 4,279,339 | 7/1981 | Gotter | 206/3 |

FOREIGN PATENT DOCUMENTS

| | | | |
|---|---|---|---|
| 2259047 | 6/1974 | Fed. Rep. of Germany | 206/3 |
| 3002284 | 7/1981 | Fed. Rep. of Germany | 206/3 |
| 0497389 | 12/1938 | United Kingdom | 206/3 |
| 0535303 | 4/1941 | United Kingdom | 206/3 |

*Primary Examiner*—William Price
*Assistant Examiner*—Jimmy G. Foster
*Attorney, Agent, or Firm*—Ronald C. Kamp; Richard B. Megley

[57] ABSTRACT

A canister to facilitate the protection and handling of ammunition having a tubular casing including a cylindrical member with a stopping means including a plurality of fixed stops which project inwardly to engage the ammunition base and thereby restrain rearward movement, and at least one deflectable finger with a tang to engage the ammunition flange and thereby restrain forward movement.

7 Claims, 6 Drawing Figures

FIG_1
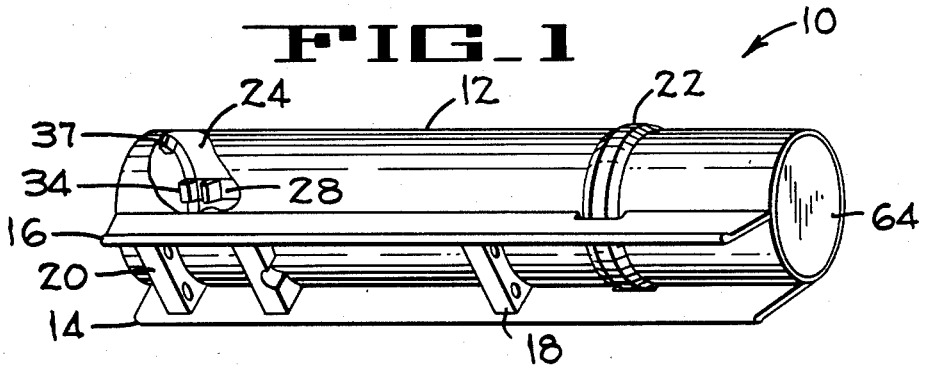
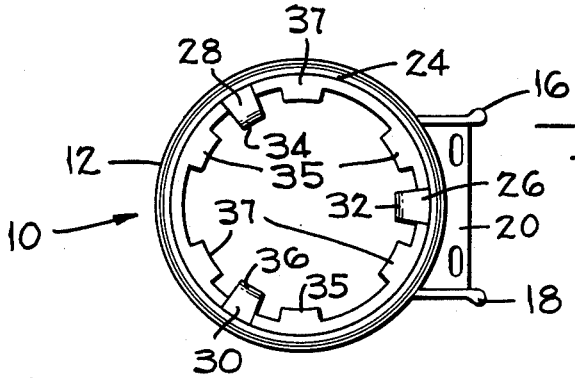
FIG_2
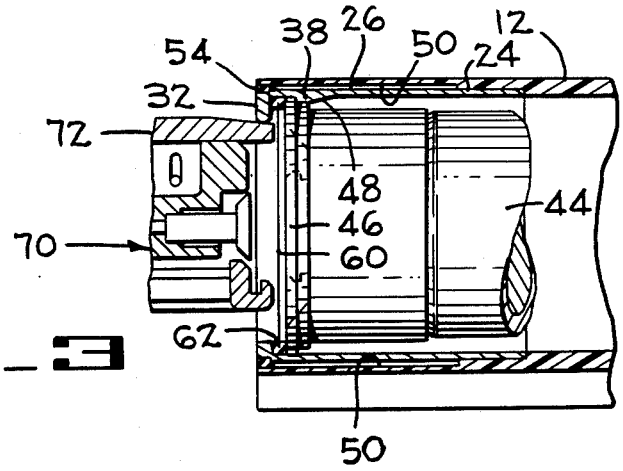
FIG_3

AMMUNITION CANISTER RESTRAINING LATCHES

This invention relates to ammunition canisters generally, and more particularly to such canisters which have releasable latches to positively restrain ammunition within the canister.

The canister provides protection for the ammunition during storage and shipment and a means to facilitate automatic handling thereof. In order to protect the ammunition from moisture, the canister must be sealed from the outside elements. Additionally, shock and vibration loads are encountered during shipment and handling which require that the ammunition be held secure within the canister. All of these considerations are important regardless of whether the ammunition is of the one piece type or the two piece type, but is especially important when the latter type includes a frangible, combustible case for the propellant. Superimposed on these requirements is the need to free the ammunition from its sealed environment within, and attachment to, the canister in order to permit it to be rammed into the gun for firing.

The present invention provides an ammunition canister which positively restrains the ammunition within the canister, which seals the canister from the outside elements, which automatically latches the ammunition to the canister when the ammunition is inserted therein, which releases the ammunition for ramming into a gun breach, which is durable, which is reusable, and which is relatively inexpensive to manufacture and maintain. These and other attributes and advantages of the present invention will become more readily apparent from a perusal of the following description in the accompanying drawings, wherein:

FIG. 1 is an isometric view of a canister according to the present invention with portions thereof broken away for clarity;

FIG. 2 is a bottom end view of the canister shown in FIG. 1;

FIG. 3 is a cross-sectional view of the lower or rearward portion of the canister of FIG. 1, illustrating the initial engagement of the rammer;

Referring now to FIG. 1, there is shown an ammunition canister, indicated generally at 10, which includes a tubular casing 12 to which guide rails 14 and 16 are attached. Handling lugs 18 and 20 are attached to the casing between the guide rails 14 and 16. The guide rails provide support for the canister during at least a portion of the ammunition handling procedure, while the lugs 18 and 20 provide a means for physically grasping and moving the canister. A passive restraint, indicated generally in 22, is provided near the upper or forward end of the canister 10. This restraint includes three elastomeric pads, now shown, equi-angularly spaced, which project through complementary openings in the casing 12 to stabilize the upper or forward portion of the ammunition. The pads are held in place by a rubber strap encircling the casing. The pad and strap cooperate to seal the aforementioned openings.

Figure 6:
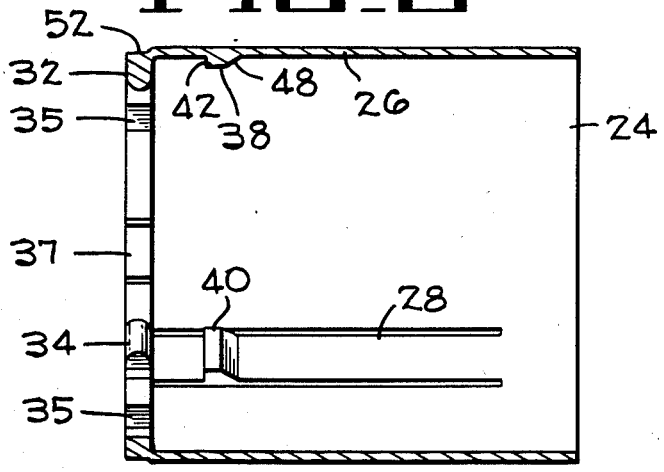
FIG. 6 is a cross-sectional view taken on line 6—6 of FIG. 5.

The casing 12 is preferably made of a plastic material such as acrylonitrile butadiene (ABS) or polyvinyl chloride (PVC). A cylindrical member 24, which may be an aluminum die or investment casting, is seated in a recess formed by an increased internal diameter of the casing 12 and is bonded thereto, such as by adhesive. Three deflectable sections or fingers 26, 28 and 30, each of which function as a leap spring, are formed in the cylindrical member 24, such as by forming a pair of parallel longitudinal slits in the member 24 to define each of the fingers. The fingers are spaced at 120 degrees. The free end of each finger 26, 28, and 30 is provided with an inward projecting tab 32, 34 and 36 respectively, each of which is rounded at the inner end to function as a cam follower in a manner to be explained hereafter. A plurality of stops are also provided on the member 24 to restrain movement of the ammunition in a direction toward the bottom or rearward end of the casing 12, while permitting the rammer head to be inserted inside the casing. These stops preferably take the form of short inwardly projecting tabs positioned on either side of each of the fingers, such as shown at 35 and 37. A tang, such as shown at 38 and 40 on fingers 26 and 28, respectively, in FIG. 6, is provided on the inside surface of each finger. Each tang defines a shoulder, as best seen at 42 in connection with tank 38 in FIG. 6, which engages a flange or annular recess, as the case may be, formed in the ammunition to restrain movement of the ammunition toward the forward or upper end of the casing 12. While ammunition has been used herein to collectively refer to single piece ammunition, and to either the projectile or the casing for the propellant of two piece ammunition, the illustration of FIG. 3 shows a propellant casing as an example, which casing is generally indicated in 44 and has a flange 46 which is trapped between the tabs 35 and 37 and the shoulder of tang 38. A ramp such as shown at 48 in FIGS. 3 and 6 is provided to cam the fingers into their deflected position as the propellant casing is inserted into the canister from the top or forward end of the casing 12. As the flange 46 passes the tang, the deflected fingers will automatically return to normal and latch the propellant casing to the casing 12. In order to accomodate the deflection of the fingers 26, 28 and 30, the casing 12 is provided with an increased internal diameter section 50 which is substantially coextensive in length with the length of the fingers.

Figure 4:
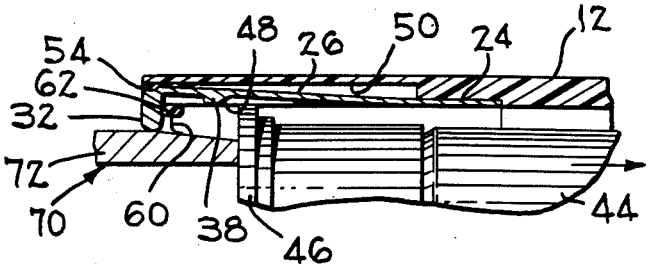
FIG. 4 is a partial cross-sectional view similar to FIG. 3 illustrating disengagement of the latch by the rammer mechanism.
Figure 5:
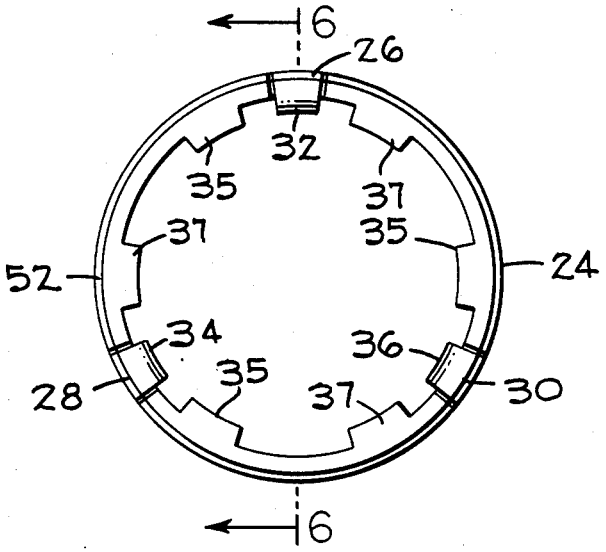
FIG. 5 is a detail plan view of the bottom or rearward end of the projectile casing shown in FIG. 1.

A reduced outside diameter, as shown at 52 in FIG. 6, is provided at the lower end of the member 24 to accept an elastomeric ring 54 (see FIGS. 3 and 4) which provides a seal between the casing 12 and the member 24. The ring 54 is sufficiently flexible to flatten-out adjacent the fingers when they are deflected, as shown in FIG. 4, and return to its original configuration when the fingers return to normal.

A seal membrane 60 which functions as a moisture barrier is seated in an elastomeric ring 62 positioned inside of the member 24 adjacent the tabs 32, 34, 36, 35, and 37. The elastomeric ring 62 serves to complete the moisture barrier and also functions as a cushion for the ammunition inside the canister 10. A similar seal membrane 64, as seen in FIG. 1, is provided at the upper end of the casing 12 to complete the isolation of the ammunition in the canister 10 from the outside environment. The fingers 26, 28, and 30 are deflected outwardly to their unlatched position by insertion of the rammer head, a portion of which is shown at 70 in FIG. 3. The rammer head 70 pierces the membrane 60 as it is inserted into the casing 12. The rammer head 70, which is conventional, inclues three guide fingers 72, which have tapered upper surfaces. These surfaces engage the inner end of the tabs 32, 34, and 36 and cam them outward as the rammer head is moved inward, i.e. toward the right as viewed in FIG. 3. Fingers 26, 28 and 30 are thereby deflected outward permitting the shoulder 42 to clear the flange 46 on the propellant case 44. The rammer 70 can then complete the ramming cycle, which includes forcing the ammunition to pierce the membrane 64. For the canister to be reused, the membranes 60 and 64 must be replaced.

While a preferred embodiment of the present invention has been disclosed and illustrated herein, it will be appreciated that various changes and modifications may be made therein without departing from the spirit of the invention as defined by the scope of the appended claims.

What is claimed is:

1. A canister to facilitate the protection and handling of ammunition having a flange adjacent its base and for use with a gun having a rammer including a guide finger; said canister comprising:

a tubular casing having forward and rearward ends for encircling said ammunition with said base adjacent said bottom end;

a cylindrical member secured inside said casing adjacent said rearward end;

stopping means including a plurality of fixed stops on said member;

each of said stops projecting inwardly to engage the base of said ammunition to preclude movement thereof beyond said rearward end;

retaining means including at least one deflectable finger formed in said member, said deflectable finger extending generally rearwardly to a free end thereof having a normal position contiguous with said member and a deflected position outwardly of said normal position;

said retaining means also including a tang formed on and projecting inwardly from said finger to engage said flange and restrain movement of said ammunition towad said forward end when said deflectable finger is in said normal position and, when said deflectable finger is in said deflected position said tang is positioned remote from and incapable of contact with said flange; and a cam surface formed on said deflectable finger and located for engagement with said guide finger when said rammer is forwardly extended to force said deflectable finger from its normal position to its deflected position.

2. The invention according to claim 1 wherein said tang includes an integral ramp engageable by said flange which permits automatic restraint of said ammunition when inserted from said forward end to and into contact with said rearward end.

3. The invention, according to claim 1, and further comprising;

a first seal membrane covering the forward end of said casing and piercible by said ammunition upon extension of said rammer;

a second seal membrane engaging the inside of said cylindrical member and piercible by said rammer upon extension thereof; and an elastomeric seal between the rear end of said casing and the cylindrical member.

4. The invention according to claim 3, wherein said casing is formed of a plastic material.

5. The invention according to claim 4, wherein said cylindrical member is bonded to said plastic material.

6. The invention according to claim 5, and further comprising a pair of guide rails secured to and extending along the longitudinal length of said casing.

7. The invention according to claim 6 and further comprising handling lugs secured to and positioned between said guide rails.

* * * * *